US005567043A

United States Patent [19]

Swanson

[11] Patent Number: 5,567,043

[45] Date of Patent: Oct. 22, 1996

[54] TORCHIERE LAMP WITH VERTICALLY ADJUSTABLE TASK LIGHT

[75] Inventor: Dennis K. Swanson, Woodland Hills, Calif.

[73] Assignee: Lamps Plus, Inc., Chatsworth, Calif.

[21] Appl. No.: 557,893

[22] Filed: Nov. 14, 1995

[51] Int. Cl.[6] ..... F21V 21/14

[52] U.S. Cl. ..... 362/250; 362/413

[58] Field of Search ..... 362/413, 250

[56] References Cited

U.S. PATENT DOCUMENTS 4,453,204 6/1984 Warshawsky ..... 362/413

4,484,255 11/1984 Warshawsky ..... 362/413

*Primary Examiner*—Carroll B. Dority

*Attorney, Agent, or Firm*—Robbins, Berliner & Carson, LLP

[57] ABSTRACT

A torchiere lamp having a base and an upwardly directed general area lighting fixture supported upon a stem extending from the base. A task light is supported upon a rod which passes through a pair of anchors secured to the stem so that the rod is disposed substantially parallel to the stem. One of the anchors carries a locking member in the form of a threaded thumb screw which may be loosened to permit vertical and rotational movement of the rod for positional adjustment of the task light. The task light includes a reflector or shade pivotally attached to the rod to thereby permit further rotational and pivotal adjustment of the reflector.

10 Claims, 3 Drawing Sheets

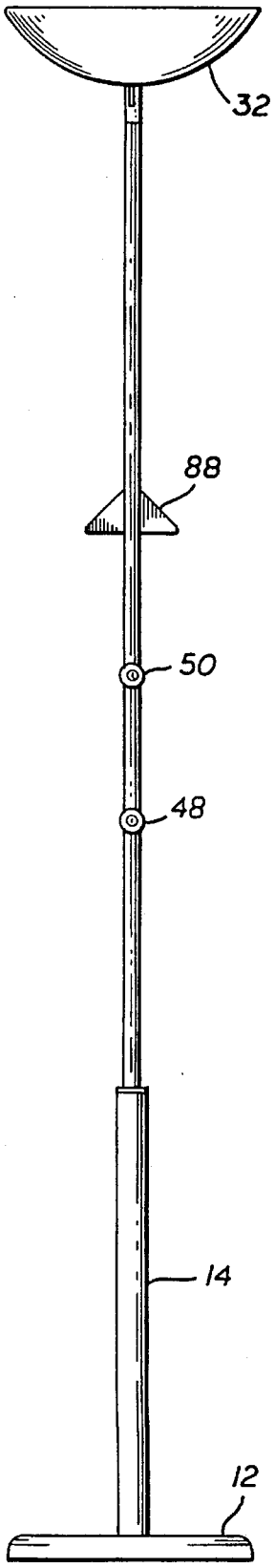
FIG. 6
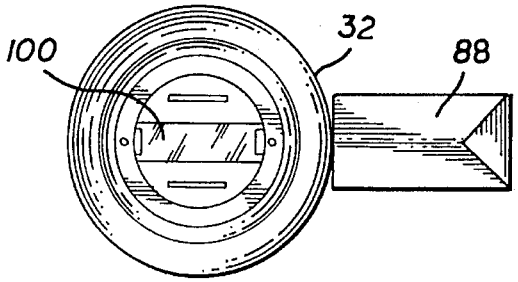
FIG. 7
FIG. 8
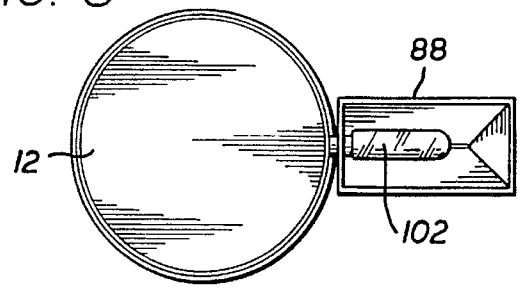
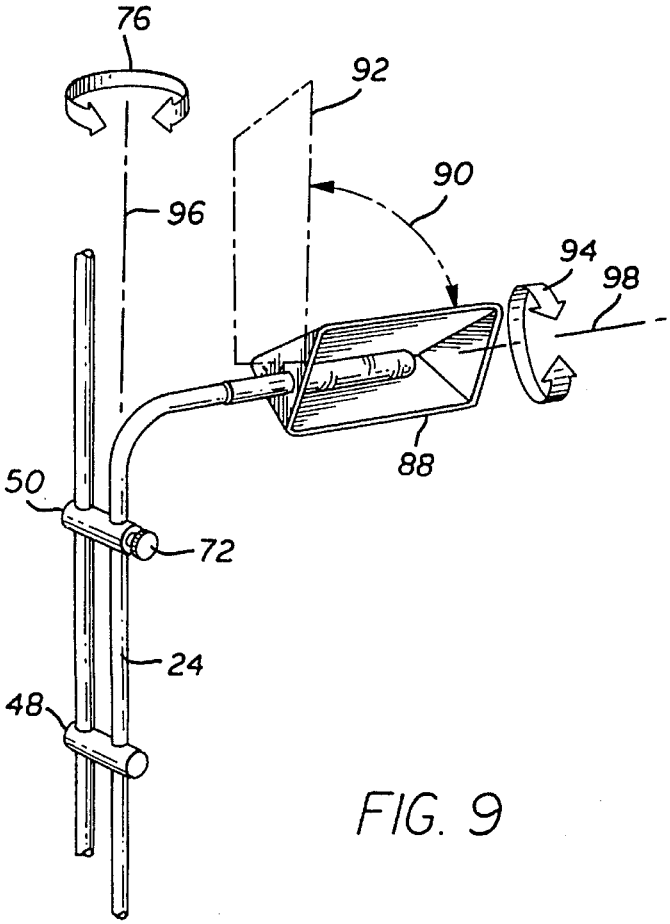
FIG. 9

TORCHIERE LAMP WITH VERTICALLY ADJUSTABLE TASK LIGHT

BACKGROUND OF THE INVENTION

1. Field of the Invention

The present invention relates generally to electric lighting apparatus and more particularly to a torchiere electric lamp which includes the combination of a general area lighting and vertically and rotationally adjustable task lighting on the same structure.

2. Prior Art

Electric lighting apparatus in the form of floor lamps and table lamps is well known. Such lamps generally take the form of a general area lighting device or alternatively, a task lighting device. A general lighting apparatus is one which provides lighting for a predetermined area without particular concern for directing the light for reading, highlighting specific items such as paintings or the like or otherwise. On the other hand, task lighting focuses the light through the utilization of reflectors for use for a specific purpose such as reading, to highlight a given area, to accent some item such as a sculpture, painting or the like. An example of task lighting structures are the well known pole lamps or track lighting structures.

While the prior art general area lighting devices and task lighting devices have functioned quite well for the specific purposes intended, Applicant is unaware of any prior art which combines both general area lighting and vertically positionable task lighting which may also be rotationally and pivotally adjusted.

SUMMARY OF THE INVENTION

A torchiere electric lamp which includes a base member for supporting the same, an elongated hollow stem rising centrally from the base member, and a general area lighting means carried by the opposite end of the stem. A separate direct task light is affixed to one end of a rod which is attached to the stem between the base and the general area lighting means. The rod may be vertically positioned relative to the stem and then nonmovably fixed in the desired position. Electrical wiring is disposed within the hollow stem and within the rod and is combined with switch means for individually controlling the application of electrical energy to each of the general area lighting means and the separate direct task light.

BRIEF DESCRIPTION OF THE DRAWINGS

FIG. 6 is a right elevational view of the lamp as illustrated in FIG. 1;

FIG. 7 is a top view thereof;

FIG. 8 is a bottom view thereof; and

FIG. 9 is a fragmentary perspective view further illustrating the adjustability of the task light.

DETAILED DESCRIPTION

Figure 1:
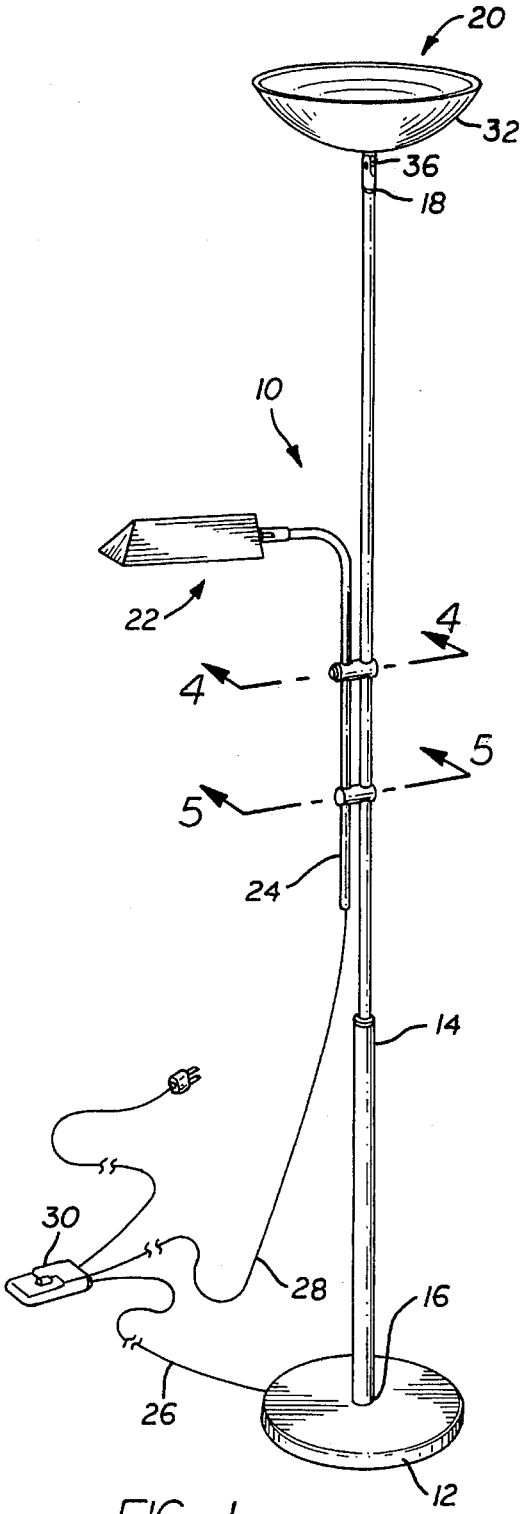
FIG. 1 is a perspective view illustrating a stand-alone electric lamp constructed in accordance with the principals of the present invention.

As illustrated in the drawings and more particularly in FIG. 1, there is provided a stand-alone lamp 10 having a base 12 from which extends a hollow stem 14. The stem has a first end 16 which is rigidly and permanently affixed to the base 12 at approximately the center thereof. A second end 18 of the stem 14 is affixed to a general area lighting means 20 with the stem 14 being permanently affixed thereto at approximately the central portion thereof. Disposed between the base 12 and the general area lighting means 20 is task lighting means 22 supported on a rod 24 secured to the stem 14.

Electrical wiring 26, 28 extends through the hollow stem 14 and rod 24 and provides electrical energy to lamps which are disposed within the general purpose lighting means 20 as well as the task lighting means 22. Switch means such as a foot operated switch 30 is provided to individually control the application of electrical energy to the lighting sources disposed within the lighting means 20 and 22. The switch 30 functions as a full dimmer switch which can turn the lamp in the general purpose lighting means 20 off and on as well as from full dim to full bright. The switch 30 also is utilized to turn the light source contained within the task light 22 on or off and, alternatively, also may be two-way, three-way, or dimmer switch if such is desired.

Figure 3:
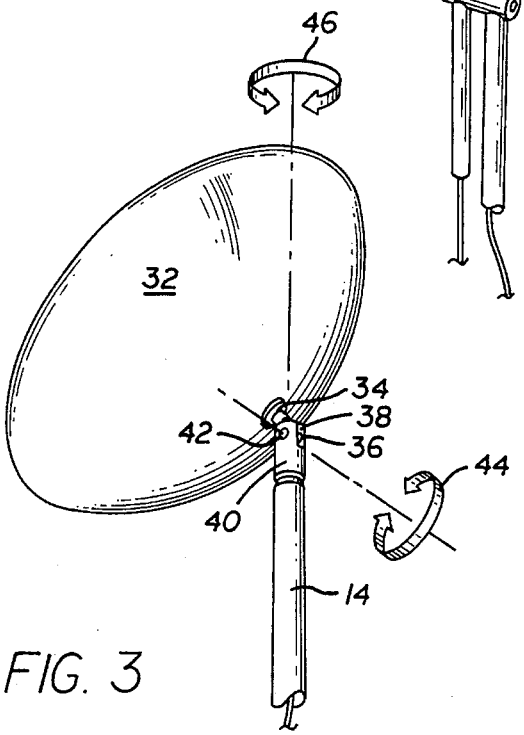
FIG. 3 is a fragmentary view illustrating the adjustable feature of a general area lighting means forming a part of the lamp as illustrated in FIG. 1.

As is illustrated in FIGS. 1, 3 and 6 the general purpose lighting means may include an upwardly directed bowl or pan shaped member 32. The pan shaped member includes a central portion 34 which has a tongue 36 extending therefrom and into a slotted opening 38 provided in a fitting 40 which is secured to the upper end of the stem 14. The tongue 36 is secured by a pivot pin 42 extending across the slot or opening 38 and through the tongue 36. The attachment allows the pan shaped dish 32 to pivot as indicated by the arrow 44 so that it may direct the light emanating from the general area lighting means in a direction other than directly upwardly. The fitting 40 is also affixed to the stem 14 in such a manner that the pan 32 may be rotated as is illustrated by the arrow 46. This ability to manipulate the pan shaped reflector 32 also facilitates packaging of the lamp for transport.

Figure 2:
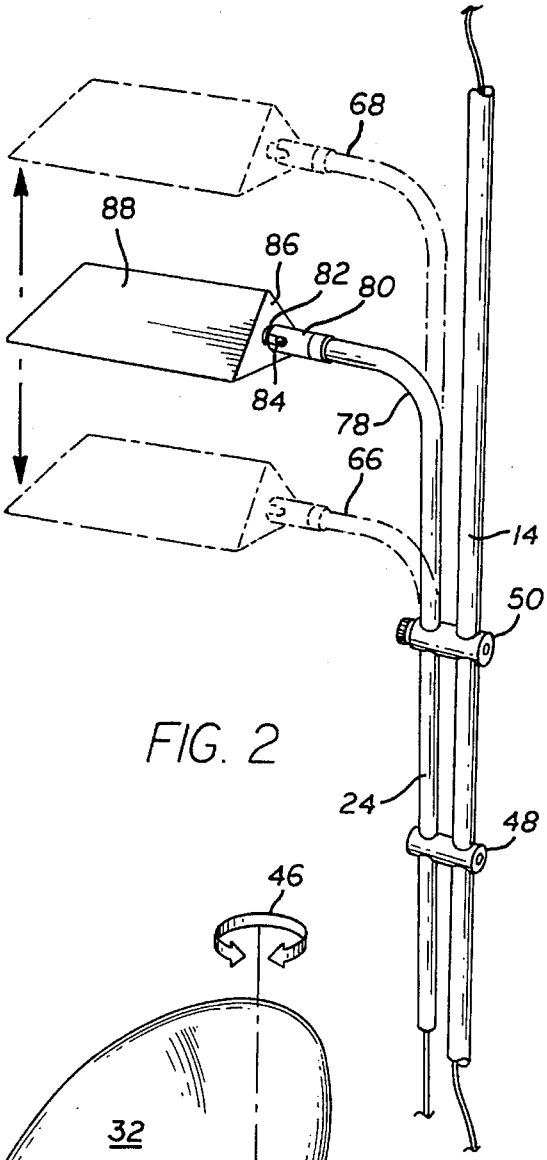
FIG. 2 is a fragmentary perspective view illustrating in more detail the vertical positioning of a task light forming a part of the lamp as illustrated in FIG. 1.
Figure 4:
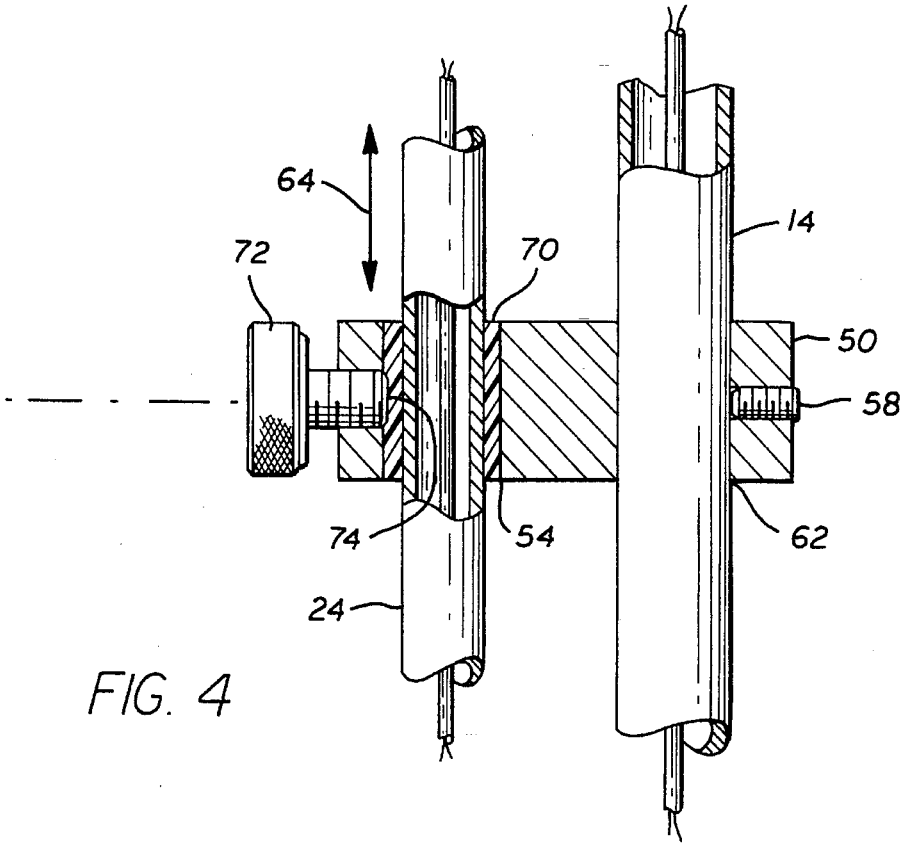
FIGS. 4 and 5 are fragmentary cross-sectional views taken about the lines 4—4 and 5—5 of FIG. 1 illustrating the adjustability of the task light.
Figure 5:
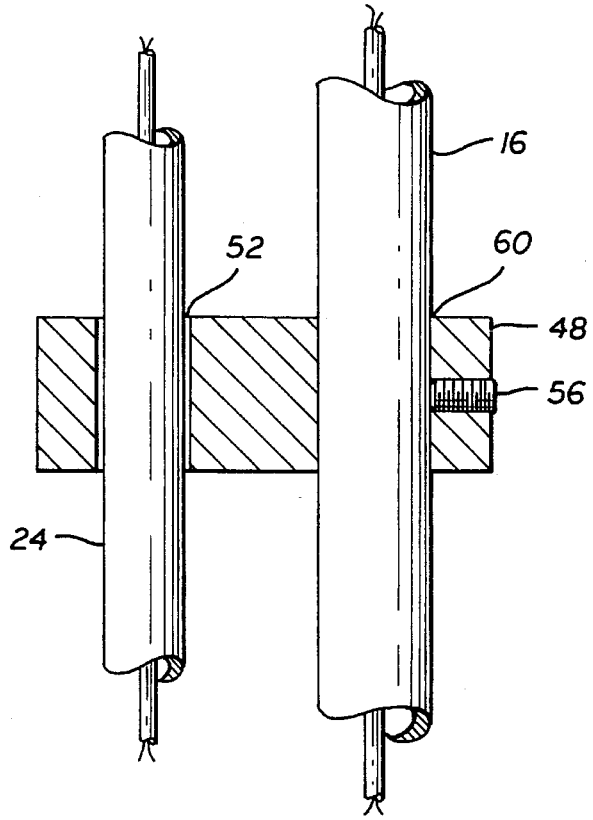

As is illustrated more particularly in FIGS. 2, 4 and 5 the task light means 22 is attached to a rod 24 which rod is disposed substantially parallel to the stem 14. The rod 24 is secured in place by attachment means such as first and second spaced apart anchor means 48 and 50 which are secured to the stem 14. Each of the anchors 48 and 50 define openings 52 and 54 respectively for receiving the rod 24. The anchor means 48 and 50 are secured in place on the stem 14 by means of a threaded pin 56 and 58 such for example as an allen screw. As is clearly shown in FIGS. 4 and 5 the stem 14 extends through openings 60 and 62 in the anchors 48 and 50 respectively. The allen screws 56 and 58 may be loosened to position the anchors 48 and 50 at a desired position, both vertically and rotationally, upon the stem 14. When that position has been achieved the allen screws 56 and 58 are firmly tightened to secure the anchors 48 and 50 thereto.

The rod 24 passes through the openings 52 and 54 in the anchors 48 and 50 respectively and is freely moveable in a vertical direction as is illustrated by the arrow 64 (FIG. 4) and the dotted positions shown at 66 and 68 of FIG. 2.

As is clearly illustrated in FIG. 4 the anchor 50 includes a lock means for securing the rod 24 to the anchor 50. The lock means includes a sleeve 70 formed of a pliable material such as molded plastic which surrounds the rod 24. The lock means also includes a thumb wheel 72 which is threadably received by the anchor 50. When the thumb wheel 72 is in a first or retracted position the rod 24 is freely moveable up and down as indicated by the arrow 64. As is also indicated in FIG. 9 by the arrow 76 when the thumb screw 72 is retracted to its first position the rod 24 is rotatable within the anchors 48 and 50 to position the task light as desired. When the rod is in a desired position for purposes of directing light from the task light on a desired object the thumb screw 72 is tightened to a second position. In the second position the end 74 of the thumb screw 72 engages the plastic sleeve 70 forcing into a frictional locking engagement with the rod 24 to maintain the rod in a non-moveable position. The plastic sleeve 70 protects the surface of the rod 24 from damage by the end of the thumb screw 72.

As is also illustrated in FIGS. 2 and 9 the rod 24 is bent as shown at 78 and has a fitting 80 secured to the upper end thereof. The fitting 80 has a slotted interior 82 and is adapted to receive a ball 84 which extends from the surface 86 of a light reflector or shade 88 which takes the form of a tent like structure. The fitting 80 and the ball 84 provide essentially a ball and socket joint allowing the tent like shade or reflector 88 to be pivoted as shown by the arrow 90 and the dotted position 92 thereof in FIG. 9. The structure also permits the shade 88 to be rotated as shown by the arrow 94.

As is clearly shown in the drawings and above described, the task light 22 is vertically adjustable, may be rotated about the axes 96 and 98 and is pivotal with respect to the rod 24.

As above described the general purpose lighting means 20 as well as the task light 22 may have appropriate illumination sources such as a halogen light 100 or an incandescent bulb 102 respectively as illustrated in FIGS. 7 and 8. The interior surfaces of the reflectors 32 and 88 may be treated in such a manner as to reflect the light from the light sources 100 and 102.

The present invention has been described in its preferred embodiment as is illustrated in the accompanying drawings, however it should be understood that the invention is not limited by such description and illustration but rather is measured by the scope of the claims appended hereto.

What is claimed is:

1. A torchiere lamp comprising:

(1) a base member;

(2) a stem member connected to and rising centrally from said base member;

(3) a general area lighting means connected to said stem member at an end thereof opposite said base member;

(4) a rod disposed adjacent to and substantially parallel with said stem member;

(5) attachment means for securing said rod to said stem and having first and second positions, said rod being vertically movable relative to said stem member when said attachment means is in said first position but being non-movable when said attachment means is in said second position; and (6) task light means affixed to and movable with said rod.

2. A torchiere lamp as defined in claim 1 which further includes means for pivotally attaching said general area lighting means to said stem member.

3. A torchiere lamp as defined in claim 1 wherein said rod means is rotatable when said attachment means is in said first position.

4. A torchiere lamp as defined in claim 3 in which said task light means includes a reflector means adjustably secured to said rod.

5. A torchiere lamp as defined in claim 4 wherein said reflector means is a tent shaped reflector and is rotatably and pivotally secured to said rod.

6. A torchiere lamp as defined in claim 1 wherein said attachment means includes first and second spaced apart anchor means secured to said stem and defining an opening therethrough for receiving said rod, said opening in said first anchor means receiving a lock means for securing said rod.

7. A torchiere lamp as defined in claim 6 wherein said lock means includes a thumb screw.

8. A torchiere lamp as defined in claim 7 wherein said lock means further includes a plastic sleeve received within said opening in said first anchor means, said sleeve surrounding said rod, said thumb screw engaging said sleeve and pressing it into frictional locking position with said rod when said thumb screw is in said second position.

9. A torchiere lamp as defined in claim 8 wherein each of said anchor means is slidably positionable upon said stem member and further includes means for securing each said anchor means in a non-movable fashion with respect to said stem member.

10. A torchiere lamp as defined in claim 1 wherein said rod is rotatable when said attachment means is in said first position and which further includes fitting means for affixing said task light means to an end of said rod, said fitting permitting said task light means to be rotated and pivoted with respect to said rod.

* * * * *